US007559278B2

(12) United States Patent
Hoffmann et al.

(10) Patent No.: US 7,559,278 B2
(45) Date of Patent: Jul. 14, 2009

(54) APPARATUS AND METHOD FOR A PRINTING-PRESS CYLINDER SLEEVE

(75) Inventors: Eduard Hoffmann, Bobingen (DE); Angelika Keck, Munich (DE); Peter Knauer, Muenster/Lech (DE); Klaus T. Reichel, Augsburg (DE); Josef Singler, Binswangen (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 467 days.

(21) Appl. No.: 11/271,297

(22) Filed: Nov. 12, 2005

(65) Prior Publication Data

US 2006/0122046 A1 Jun. 8, 2006

(30) Foreign Application Priority Data

Nov. 13, 2004 (DE) ..... 10 2004 054 983

(51) Int. Cl.
*B41F 13/10* (2006.01)

(52) U.S. Cl. ..... 101/375; 101/376

(58) Field of Classification Search ..... 101/375, 101/376

See application file for complete search history.

(56) References Cited

U.S. PATENT DOCUMENTS 2,071,945 A * 2/1937 Oelkers et al. ..... 384/459
3,844,182 A * 10/1974 Bradshaw et al. ..... 74/498
5,522,315 A * 6/1996 Behnke et al. ..... 101/376
5,863,367 A 1/1999 Behnke et al.
6,515,650 B2 * 2/2003 Arita et al. ..... 345/156
7,073,435 B2 * 7/2006 Vrotacoe et al. ..... 101/217
7,104,198 B2 * 9/2006 Weiler et al. ..... 101/376
7,168,857 B2 * 1/2007 Hokkirigawa et al. ..... 384/110
2003/0031812 A1 2/2003 Bertoncini et al.

FOREIGN PATENT DOCUMENTS

DE 199 50 643 A1 4/2001
EP 0 819 550 B1 1/1998
WO WO 2005/005157 A1 1/2005

* cited by examiner

*Primary Examiner*—Anthony H. Nguyen
(74) *Attorney, Agent, or Firm*—Crowell & Moring LLP

(57) ABSTRACT

A sleeve, in particular a rubber-blanket sleeve, for a printing press is disclosed. The sleeve having a construction which has at least two layers, having an inner layer which is configured as a carrier layer and an outer layer which is configured as a covering layer and serves for pressure transfer, the sleeve having a hollow-cylindrical design with a cylindrical inner surface and a cylindrical outer surface. The inner layer which is configured as a carrier layer is convexly or concavely curved on the radially outer side, a layer which adjoins the carrier layer having a curvature on a radially inner side which is complementary to the curvature of the radially outer side of the carrier layer.

4 Claims, 2 Drawing Sheets

APPARATUS AND METHOD FOR A PRINTING-PRESS CYLINDER SLEEVE

This application claims the priority of German Patent Document No. 10 2004 054 983.4, filed Nov. 13, 2004, the disclosure of which is expressly incorporated by reference herein.

BACKGROUND AND SUMMARY OF THE INVENTION

The invention relates to a sleeve, in particular a rubber-blanket sleeve.

Sleeves help printing-press cylinders to roll over one another in a smooth manner due to the lack of interruption by clamping channels on the circumference of the cylinders, which would otherwise usually be present.

German Patent Document No. DE 199 50 643 A1 discloses a sleeve for a web-fed rotary offset press, which sleeve has a construction which has a total of four layers. The sleeve according to DE 199 50 643 A1 has an inner layer which is configured as a carrier layer and an outer layer which is configured as a covering layer and serves for pressure transfer, there being two further layers between the carrier layer and the covering layer. The sleeve according to DE 199 50 643 A1 has a hollow-cylindrical design with a cylindrical inner surface and a cylindrical outer surface, all of the layers of the sleeve having cylindrical inner surfaces and cylindrical outer surfaces.

European Patent Document No. EP 0 819 550 B1 discloses a sleeve for a printing press, which sleeve has a cylindrical outer surface and a conical inner surface. Accordingly, the sleeve according to EP 0 819 550 B1 does not have a hollow-cylindrical design.

Proceeding from this, the present invention is based on the problem of providing a novel sleeve, in particular a novel rubber-blanket sleeve.

According to the invention, the inner layer which is configured as a carrier layer is convexly or concavely curved on the radially outer side, a layer which adjoins the carrier layer having a curvature on a radially inner side which is complementary to the curvature of the radially outer side of the carrier layer.

In the context of the present invention, a multiple-layer sleeve for a printing press is provided, which sleeve has an overall hollow-cylindrical design with a cylindrical inner surface and a cylindrical outer surface. According to the invention, the carrier layer is of cylindrical configuration on its radially inner side and either convexly or concavely curved on its radially outer side. A layer which adjoins the carrier layer has a curvature on a radially inner side which is complementary to the curvature of the radially outer side of the carrier layer. A completely novel construction for a hollow-cylindrical sleeve is provided by the present invention, sides of adjoining layers of the sleeve which lie opposite one another having complementary curvatures, with the result that the outer contour of the sleeves does not deviate ultimately from a hollow-cylindrical shape. As a result, it is possible to realize completely novel sleeve properties. Line-force distributions of the outer, printing and web-guiding covering layers can be influenced by the sleeves according to the invention.

BRIEF DESCRIPTION OF THE DRAWINGS

Preferred developments of the invention result from the following description. Without being restricted thereto, exemplary embodiments of the invention are explained in greater detail using the drawings.

DETAILED DESCRIPTION OF THE DRAWINGS

In the following text, the present invention will be described in greater detail with reference to FIGS. 1 to 4.

Figure 1:
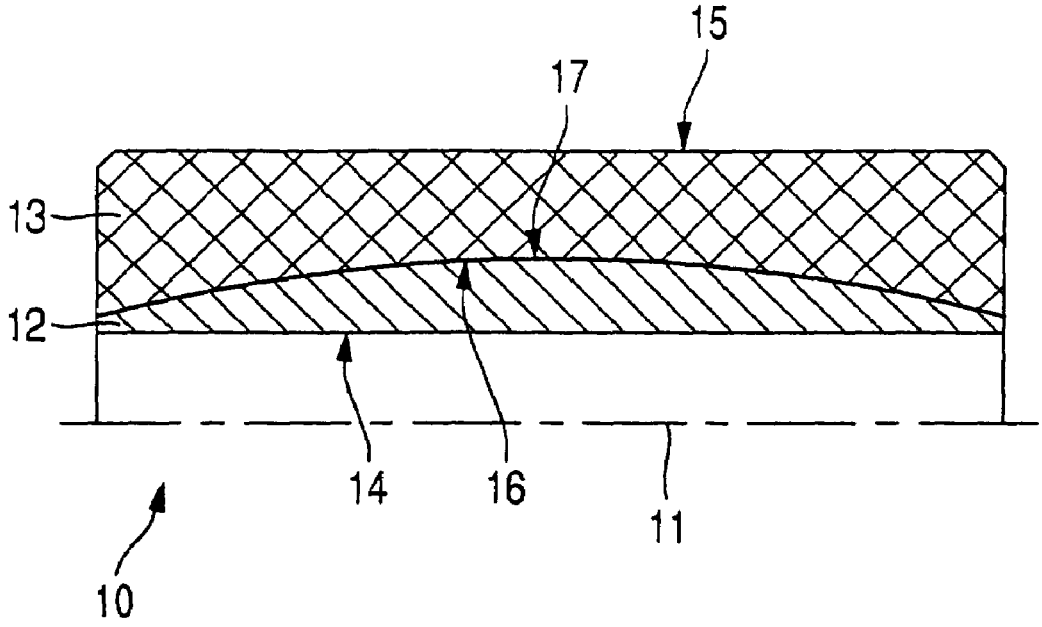
FIG. 1 shows a sleeve according to the invention in accordance with a first exemplary embodiment of the invention, in cross-section.

FIG. 1 shows a first exemplary embodiment of a sleeve 10 according to the invention in longitudinal section, a longitudinal mid-axis 11 of the sleeve 10 being shown in FIG. 1 by a dash-dotted line, and the longitudinal mid-axis 11 of the sleeve corresponding to the rotational axis of the sleeve 10 if the sleeve is positioned on a printing-press cylinder. The sleeve 10 of the exemplary embodiment from FIG. 1 has a two-layer construction comprising an inner layer which is configured as a carrier layer 12 and an outer layer which is configured as a covering layer 13, the covering layer 13 serving for pressure transfer. The sleeve 10 has a hollow-cylindrical design with a cylindrical inner surface 14 and a cylindrical outer surface 15. The outer surface 15 serves for pressure transfer. According to the invention, in the exemplary embodiment from FIG. 1, a radially outer side 16 of the carrier layer 12 is convexly curved and a radially inner side 17 of the covering layer 13 which adjoins the carrier layer 12 has a complementary curvature, that is to say is concavely curved. Accordingly, the thickness of the carrier layer 12 and of the covering layer 13 varies along the longitudinal mid-axis 11, but the thickness of the overall sleeve 10 remains unchanged.

Figure 2:
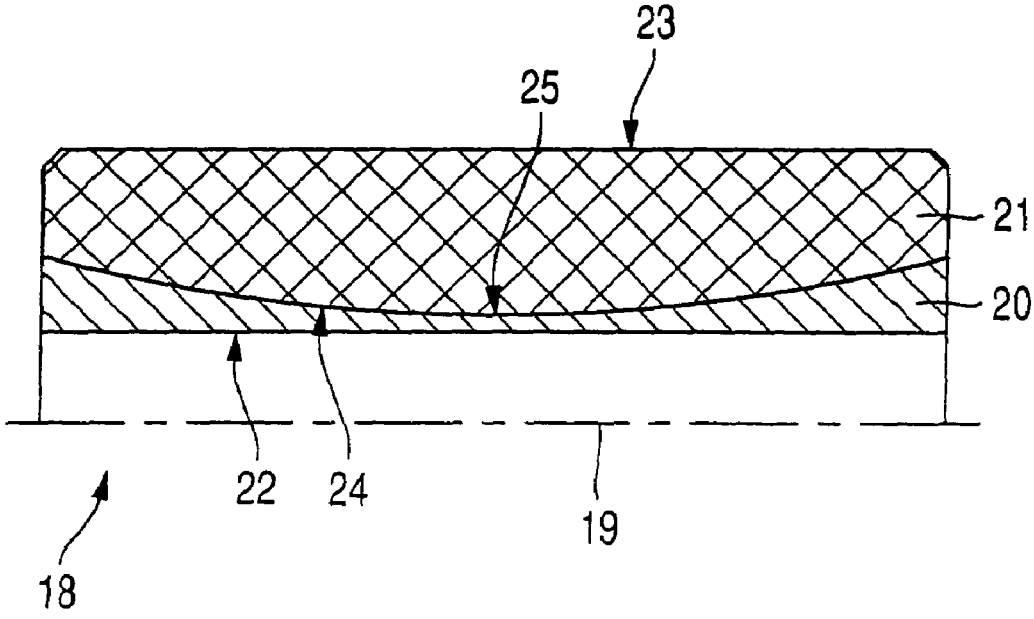
FIG. 2 shows a sleeve according to the invention in accordance with a second exemplary embodiment of the invention, in cross-section.

FIG. 2 shows a second exemplary embodiment of a sleeve 18 according to the invention. The sleeve 18 from FIG. 2 in turn has a longitudinal mid-axis 19, a carrier layer 20 and a covering layer 21. Accordingly, the sleeve 18 from FIG. 2 is likewise of two-layer configuration, like the sleeve 10 from FIG. 1, and has a hollow-cylindrical design with a cylindrical inner surface 22 and a cylindrical outer surface 23. In the exemplary embodiment from FIG. 2, a radially outer side 24 of the carrier layer 20 is concavely curved, and a radially inner side 25 of the covering layer 21 is convexly curved. Accordingly, in the exemplary embodiment from FIG. 2, those sides 24 and 25 of the adjoining layers 20 and 21 which lie opposite one another have complementary curvatures.

Figure 3:
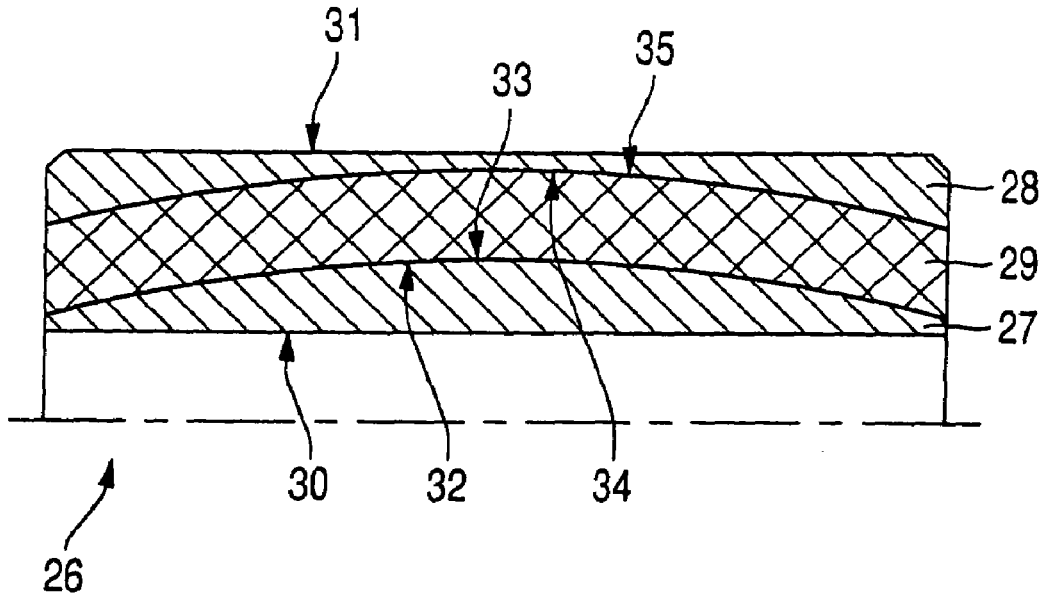
FIG. 3 shows a sleeve according to the invention in accordance with a third exemplary embodiment of the invention, in cross-section.
Figure 4:
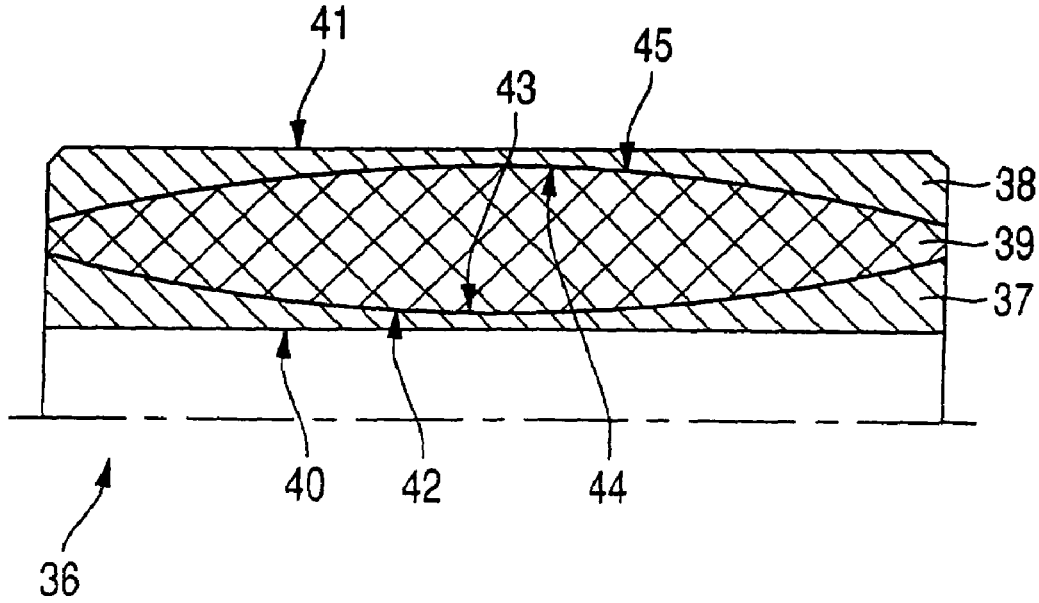
FIG. 4 shows a sleeve according to the invention in accordance with a fourth exemplary embodiment of the invention, in cross-section.

Two-layer sleeves 10 and 18 are shown in the exemplary embodiments from FIGS. 1 and 2, respectively. FIGS. 3 and 4 show sleeves according to the invention which have a three-layer construction.

FIG. 3 thus shows a sleeve 26 with an inner layer 27, a covering layer 28 and an intermediate layer 29 which is positioned between the inner layer 27 and the covering layer 28. The sleeve 26 in turn has a hollow-cylindrical design with a cylindrical inner surface 30 and a cylindrical outer surface 31, the cylindrical outer surface 31 serving for pressure transfer. In the exemplary embodiment from FIG. 3, a radially outer side 32 of the carrier layer 27 is convexly curved and an adjoining, radially inner side 33 of the intermediate layer 29 has a complementary, that is to say concave, curvature. A radially outer side 34 of the intermediate layer 29 is convexly curved and an adjoining, radially inner side 35 of the outer covering layer 28 is concavely curved. Accordingly, the adjoining sides 34 and 35 of the intermediate layer 29 and the outer covering layer 28 also have complementary curvatures. In conjunction with the exemplary embodiment from FIG. 3, it is to be pointed out that, in the context of the present invention, the radially outer side 34 of the intermediate layer 29 and the radially inner side 35 of the covering layer 28 can also have cylindrical contours. Furthermore, it is possible for the radially outer side 34 of the intermediate layer 29 to be concavely curved and for the radially inner side 35 of the covering layer 28 to be convexly curved.

FIG. 4 shows a further exemplary embodiment of a sleeve 36 according to the invention. The three-layer sleeve 36 from FIG. 4 in turn has an inner layer 37, a covering layer 38 and an intermediate layer 39 which is positioned between the inner layer 37 and the covering layer 38. The sleeve 36 from FIG. 4 in turn has an overall hollow-cylindrical design with a cylindrical inner surface 40 and a cylindrical outer surface 41. A radially outer side 42 of the inner layer 37 is concavely curved and a radially inner side 43 of the intermediate layer 39 is convexly curved, with the result that those sides 42 and 43 of the adjoining inner layer 37 and intermediate layer 39 which lie opposite one another have complementary curvatures. A radially outer side 44 of the intermediate layer 39 is convexly curved and a radially inner side 45 of the covering layer 38 is concavely curved, with the result that these sides 44 and 45 which adjoin one another also have complementary curvatures.

In the context of the present invention, it goes without saying that the number of layers of the sleeve and the concrete curvatures of the adjoining sides which are curved in a complementary manner can be varied. A common feature of all the exemplary embodiments is that the radially outer sides 16, 24, 32 and 42 of the carrier layers 12, 20, 27 and 37, respectively, are either concavely or convexly curved, and that the adjoining side 17, 25, 33 and 43 of the adjoining layer 13, 21, 29 and 39, respectively, has a complementary curvature. The sleeves 10, 18, 26 and 36 have a hollow-cylindrical design with a cylindrical inner surface and a cylindrical outer surface.

In the exemplary embodiments shown, the carrier layers 12, 20, 27 and 37 of the sleeves according to the invention are of preferably incompressible and metallic configuration. The covering layers 13, 21, 28 and 38 which serve for pressure transfer are of compressible design and are preferably configured as rubber layers.

LIST OF REFERENCE SYMBOLS

10 Sleeve
11 Longitudinal mid-axis
12 Carrier layer
13 Covering layer
14 Inner surface
15 Outer surface
16 Radially outer side
17 Radially inner side
18 Sleeve
19 Longitudinal mid-axis
20 Carrier layer
21 Covering layer
22 Inner surface
23 Outer surface
24 Radially outer side
25 Radially inner side
26 Sleeve
27 Carrier layer
28 Covering layer
29 Intermediate layer
30 Inner surface
31 Outer surface
32 Radially outer side
33 Radially inner side
34 Radially outer side
35 Radially inner side
36 Sleeve
37 Carrier layer
38 Covering layer
39 Intermediate layer
40 Inner surface
41 Outer surface
42 Radially outer side
43 Radially inner side
44 Radially outer side
45 Radially inner side The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A sleeve, in particular a rubber-blanket sleeve, for a printing press, comprising an inner layer which is configured as a carrier layer and an outer layer which is configured as a covering layer and serves for pressure transfer, the sleeve having a hollow-cylindrical design with a cylindrical inner surface and a cylindrical outer surface, wherein the inner layer which is configured as the carrier layer has a curvature that is concavely curved on a radially outer side, and wherein the outer layer which is configured as the covering layer adjoins the carrier layer and has a curvature on a radially inner side that is convexly curved and is complementary to the curvature of the radially outer side of the carrier layer;

wherein the radially outer side of the carrier layer adjoins the radially inner side of the covering layer and wherein a radially inner side of the carrier layer forms the cylindrical inner surface of the sleeve and a radially outer side of the covering layer forms the cylindrical outer surface of the sleeve.

2. The sleeve according to claim 1, wherein the carrier layer is configured as an incompressible layer and the covering layer is configured as a compressible layer.

3. The sleeve according to claim 1, wherein the carrier layer is configured as a metal layer and the covering layer is configured as a rubber layer.

4. A sleeve for a printing press, comprising:

a first layer; and a second layer;

wherein the first layer has a curvature that is concavely curved on a radially outer side and wherein the second layer adjoins the first layer and has a curvature on a radially inner side that is convexly curved and is complementary to the curvature of the radially outer side of the first layer;

and wherein the radially outer side of the first layer adjoins the radially inner side of the second layer and wherein a radially inner side of the first layer forms a cylindrical inner surface of the sleeve and a radially outer side of the second layer forms a cylindrical outer surface of the sleeve.

* * * * *